US005713140A

United States Patent [19]

Baggenstoss

[11] Patent Number: 5,713,140

[45] Date of Patent: Feb. 3, 1998

[54] RESILIENT SHOE SOLE

[76] Inventor: Alois C. Baggenstoss, 1832 SE. Enfield Ave., Port St. Lucie, Fla. 34952

[21] Appl. No.: 608,001

[22] Filed: Mar. 4, 1996

[51] Int. Cl.[6] ..... A43B 13/18; A43B 13/20

[52] U.S. Cl. ..... 36/28; 36/29

[58] Field of Search ..... 36/103, 7.8, 25 R, 36/28, 29, 142, 143, 144

[56] References Cited

U.S. PATENT DOCUMENTS

| | | | |
|---|---|---|---|
| 2,833,057 | 5/1958 | Hack | 36/59 R |
| 2,928,192 | 3/1960 | Green . | |
| 2,968,105 | 1/1961 | Rizzo | 36/7.8 |
| 3,834,046 | 9/1974 | Fowler | 36/28 |
| 4,451,994 | 6/1984 | Fowler | 36/29 X |
| 4,631,842 | 12/1986 | Koskela . | |
| 4,754,559 | 7/1988 | Cohen . | |
| 5,337,492 | 8/1994 | Anderie et al. . | |
| 5,509,218 | 4/1996 | Arcan et al. | 36/28 X |

FOREIGN PATENT DOCUMENTS

| | | | |
|---|---|---|---|
| 2489236 | 5/1982 | France . | |
| 506171 | 12/1954 | Italy . | |
| 92003069 | 3/1992 | WIPO | 36/28 |

*Primary Examiner*—Ted Kavanaugh
*Attorney, Agent, or Firm*—Quarles & Brady

[57] ABSTRACT

A shoe sole comprises plurality of downwardly extending support blocks each of which bonds to an strip of elastic sheeting that must stretch when the blocks are folded under foot pressure.

12 Claims, 3 Drawing Sheets

FIG. 1
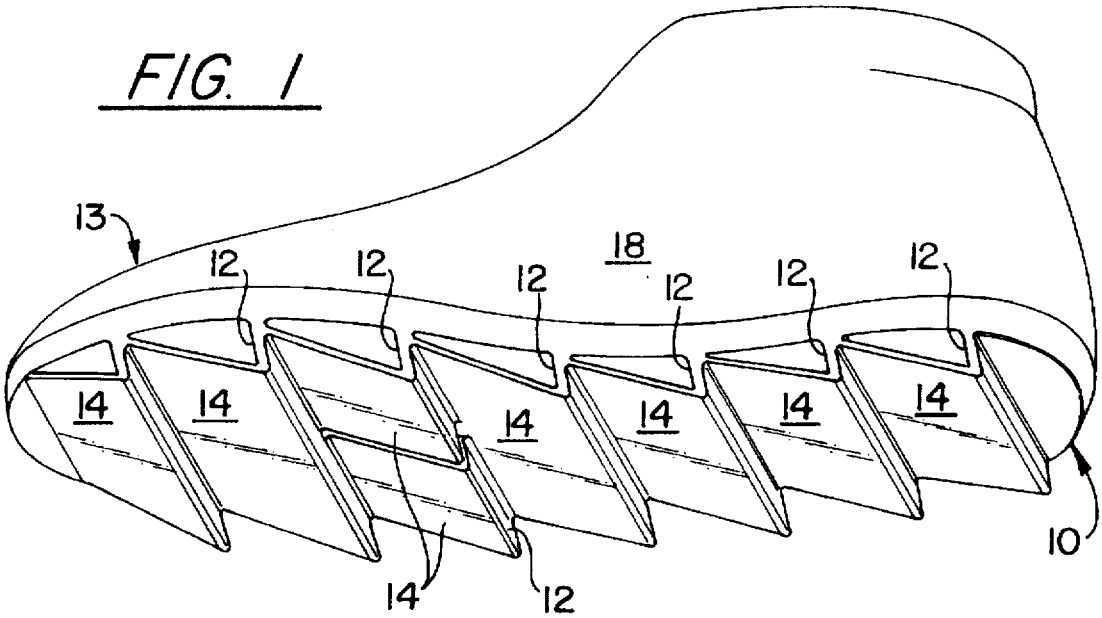
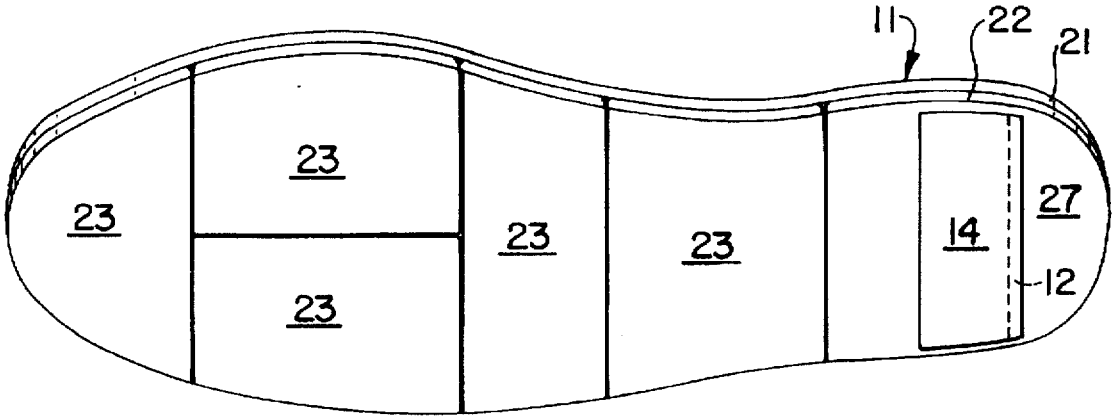
FIG. 2
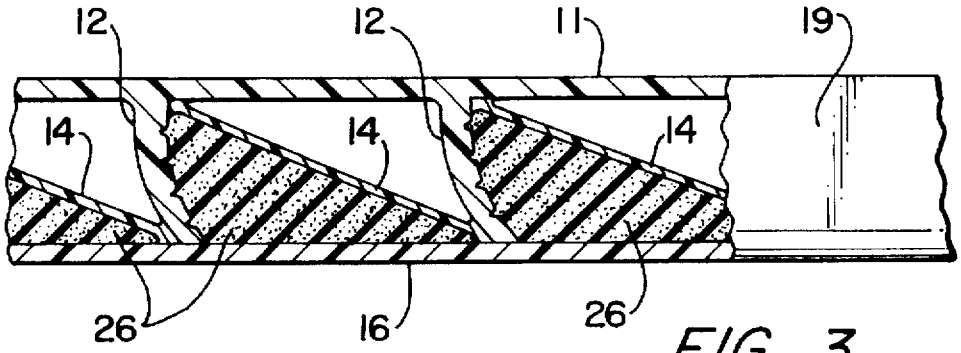
FIG. 3

RESILIENT SHOE SOLE

BACKGROUND OF THE INVENTION

Shoe manufacturers now offer a large number of sole designs that incorporate rubber or rubber-like wedges across the lower surface, and in which the wedges slant rearwardly as they descend. Hack and Hack et al. U.S. Pat. Nos. 2,710,461, 2,833,057, 2,930,149, 2,941,317, 3,299,544, and 3,444,632 belong in this category. When people walk on these soles the wedges fold under, subjecting layers of the forward elements of the wedges to tension and the rear layer elements to compression. No one, until now, has designed a sole that has pure tensile members to stretch at high elongation when the sole presses down, and snap the wedges back to normal when foot pressure relaxes.

SUMMARY OF THE INVENTION

I have invented a shoe sole with an upper layer that has a plurality of tough resilient support blocks attached to and extending downwardly from it. My shoe sole also has a plurality of strips of elastic sheeting that bond to each support block and to an area of the upper layer remote from it. One end of an edge of the sheeting attaches to the upper layer at a point some distance from the block and the other end of that edge of the sheeting attaches to the lower end of the block, away from the upper layer. Thus, when the blocks are bent, by the normal foot pressure of walking, the attached strips of sheeting are stretched in tension. Advantageously, where a sheet attaches to a support block or to the upper layer it forms a bond to that support block or layer over the full length of the edges making such attachment.

In important embodiments of my invention the support blocks slope somewhat rearwardly as they descend from the upper layer, so that they fold toward the heel when a step is taken, and stretch the sheet that is ahead of them; or, while the centerlines of the blocks don't slope, one or both of the front and rear walls of the support blocks may slope toward their centers. In other embodiments the support blocks extend substantially across the width of the sole and may have more than one strip of sheeting attached to each support block.

Nor do the support blocks of a given embodiment need always have equal vertical lengths, but may differ, so as to create a curvature in the upper layer.

Also, the upper layer, itself, of my shoe sole, may comprise two laminations, bonded together and formed from an upper continuous lamination and a lower lamination made up of a plurality of segments, which mount the support blocks. By this means the segments, including the support blocks and strips of sheeting may be mass-produced, as by casting, and later bonded to the upper laminations of the upper layers.

My shoe sole may also comprise an abrasion-resistant bottom layer bonded to the bottoms of the support blocks, and the space above this bottom layer may, advantageously, be filled with a plastic foam.

In some embodiments support blocks may be mounted normal to the upper layer and connect to two oppositely extending of the strips of sheeting.

I prefer, but do not want to be limited to, typical support block dimensions of about: ⅝ inch (15.9 mm) length, ⅜ inch (9.5 mm) width, and ⅛ inch (3 mm) depth; and a sheeting thickness of 1/16 inch (1.9)mm).

BRIEF DESCRIPTION OF THE DRAWING

FIG. 1 shows an oblique bottom view of a shoe comprising a sole of my invention.

FIG. 2 shows a bottom view of the lower lamination of an upper layer of my shoe sole.

FIG. 3 shows a lengthwise section of my shoe sole, comprising an abrasion-resistant bottom layer and side walls and having foam filling the volume beneath the strips of sheeting and the side walls.

DETAILED DESCRIPTION OF PREFERRED EMBODIMENTS

Referring first to FIG. 1 my shoe sole 10, appears as part of a shoe 13 with an upper 18. The novel shoe sole 10 comprises an upper layer 11 bonded to, or integral with, a large plurality of downwardly extending support blocks 12—12 comprised of a tough, resilient plastic or rubber material. These support blocks slope slightly toward the rear of the shoe 13, so that, when they are downwardly compressed, they will bend toward the heel.

Figure 8:
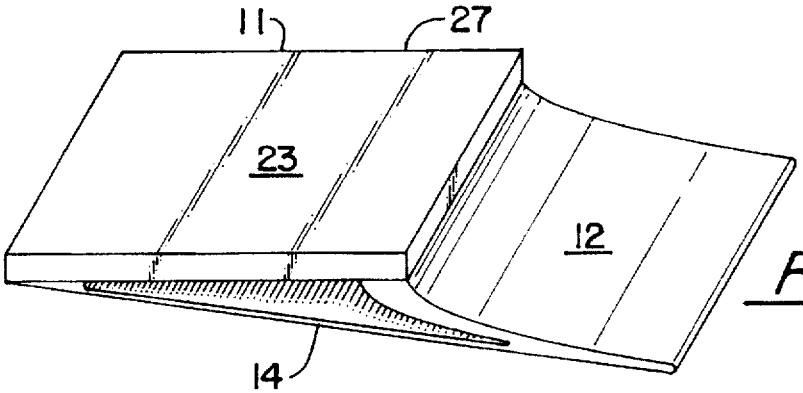
FIG. 8 shows a bounce segment with the support block folded down by foot pressure.

Strips 14—14 of elastic sheeting bond to, or may form an integral unit with, the support blocks 12, along a lower edge thereof, and also bond to the upper layer 11 aforementioned. When the support blocks 12 encounter a load, as by the shoe wearer taking a step, they bend toward the upper layer 11 as shown in FIG. 8 in the direction to which they originally inclined, and greatly stretch the strips 14 of sheeting. When the wearer starts to raise his foot, tension in the strips 14 snaps the support blocks 12 upright, providing an upward lifting sensation.

In FIG. 3 I have shown a side elevation of my shoe sole 10 in an embodiment that includes an abrasion-resistant bottom layer 16. Here an enclosing wall 19 bonds to the edges of the layers 11 and 16 and keeps the spaces between them from picking up debris. The support blocks 12 bond to the layer 11 and preferably, also, to the bottom layer 16, while the lower triangular areas, formed by the upper layer 11, support blocks 12, and bottom layer 16, is filled with a foam such as a polyurethane foam 26.

In FIG. 2 the upper layer 11 is shown obliquely comprising upper and lower laminations 21, 22 that are bonded strongly together. The upper lamination 21 is continuous but the lower lamination 22 comprises a plurality of contiguous segments 23—23, each with one or more support block 12 and strip 14 unit integral with or firmly bondable to it (see, also, FIGS. 5, 6, and 7). These lower lamination segments, with their support blocks and strips of sheeting, which may be termed "bounce segments" 27 lend themselves more readily to mass production than whole soles and I can then bond them by known means to the upper lamination 21. The provision for individual bounce segments makes it economical to provide a greater variety of the resilient sole constructions than would be practical if each sole 10 had to use the same bounce segment order of placement.

Figure 4:
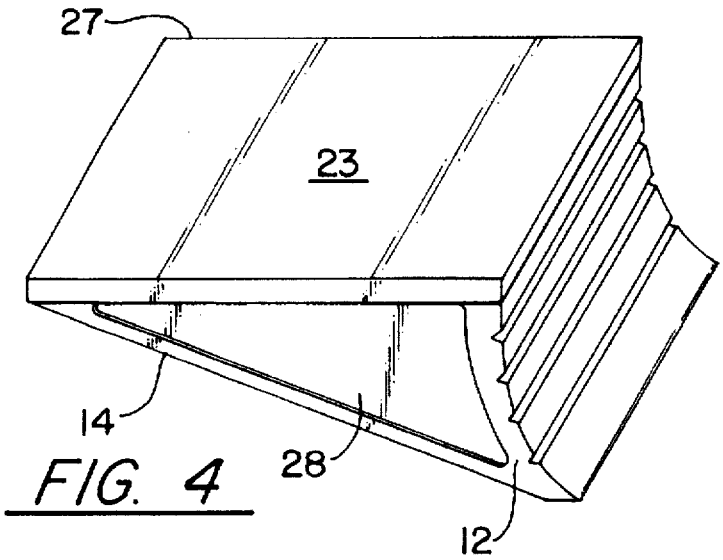
FIG. 4 shows one of the segments wherein the sides have been closed by triangular protective sheets.
Figure 5:
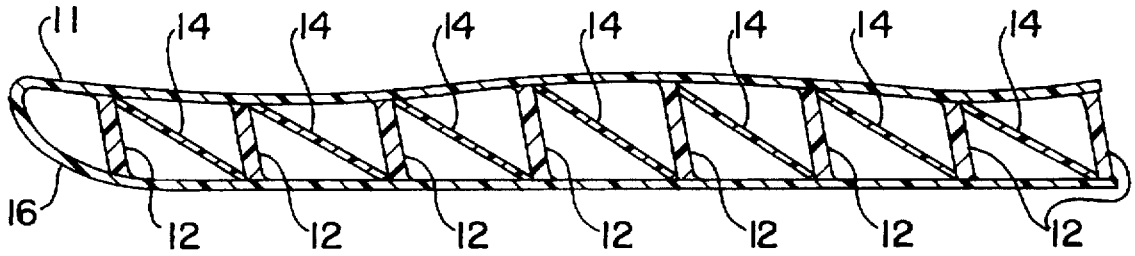
FIG. 5 shows a lengthwise section through one of my soles having support blocks of different lengths.

In FIG. 4 a bounce segment is shown that is self-contained, having triangular sheets 28, closing the spaces between the strip 14 of sheeting and support block 12. By this means intruding abrasives are excluded from wearing down the strips 14 when they are pressed against the support blocks. The use of support blocks 12 of different lengths is illustrated in FIG. 5, where it provides for an arch in the upper layer 11 of the sole 10.

Figure 6:
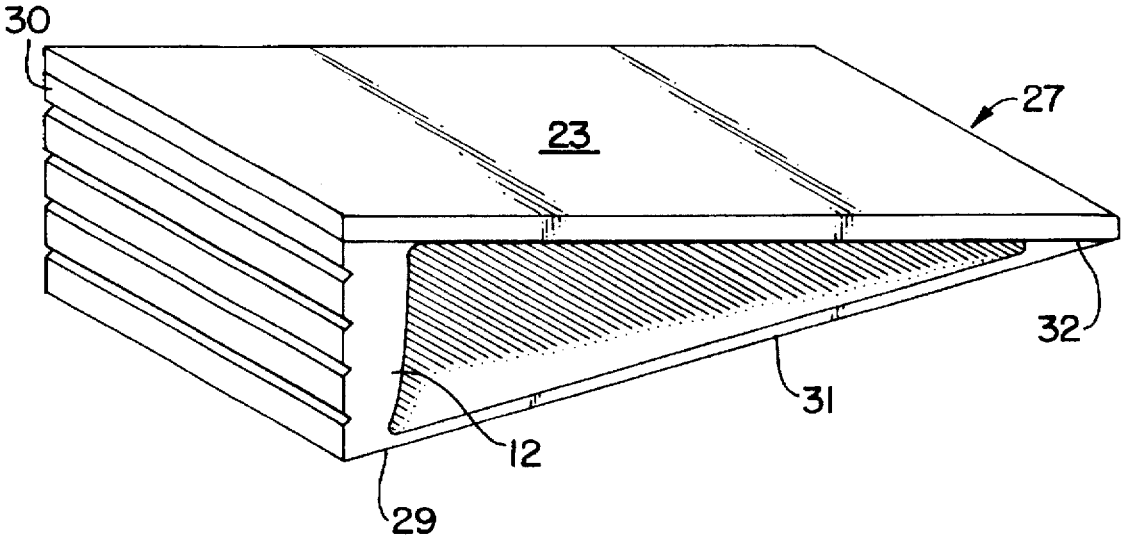
FIG. 6 shows a pictorial elevation of a segment that includes a notched support block.
Figure 7:
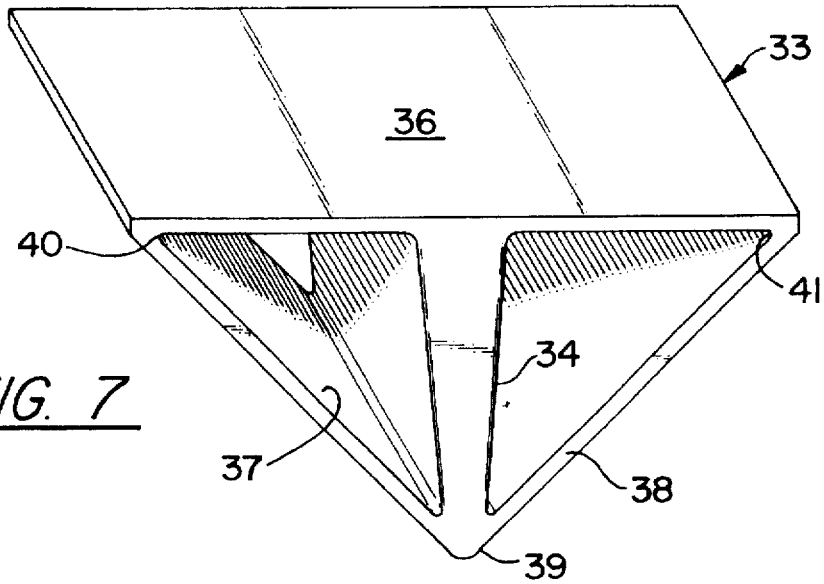
FIG. 7 shows a pictorial view of a bounce segment with balanced strips of sheeting and thick protective connections of the sheeting strips.

When the support blocks 12 are compressed the strips 14 of sheeting are pressed down against the bottoms of the folded support blocks and thus, particularly if there is no bottom layer 16, these strips 14 may be abraded against the surface of the ground. In FIGS. 6 and 7 bounce segment constructions are shown where this abrasion is minimized. A support block 30 of FIG. 6 has a tapered portion of itself bonded to (or integral with) a strip 31 of the sheeting 14. At its other end, also, the strip 31 tapers to an increased thickness 32. In FIG. 7 a bounce segment 33 has a support block 34 projecting down at right angles from a lower lamination segment 36, but with two strips of sheeting 37, 38 attached thereto. The support block 34 is broadened out at its end 39 to offer some protection against abrasion to the strips 37, 38, and the upper contact ends 40, 41 of the strips 37, 38 are also thickened for the same purpose. With this construction, whatever relative motion the lower end of the support block 34 has with the ground when it strikes, one of the two strips 37, 38 must be stretched, and ultimately provide the desired bounce.

Figure 9:
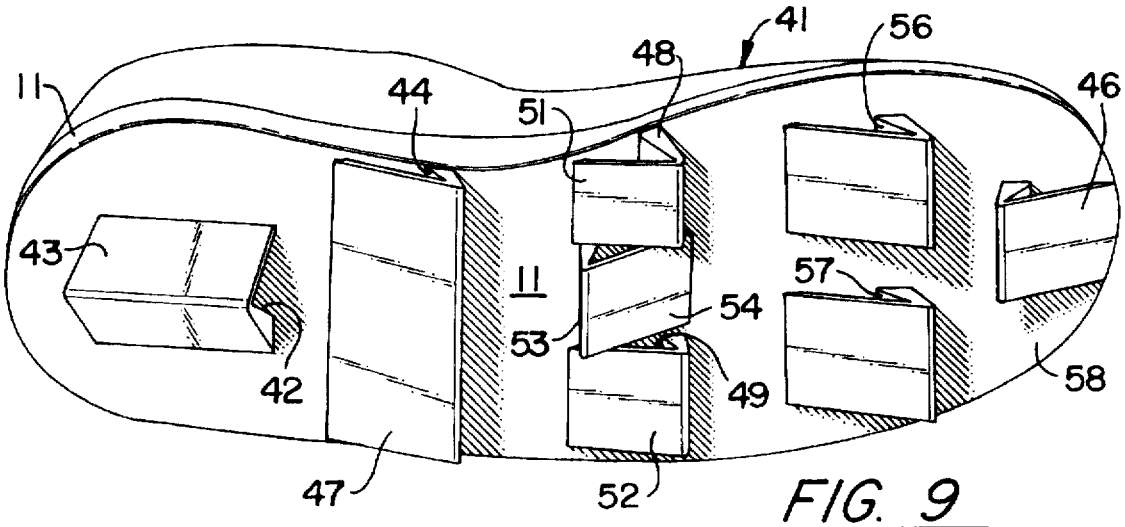
FIG. 9 shows an oblique bottom view of a shoe comprising a specialty sole of my invention where the support blocks fold in different directions.

It can be determined by comparing almost any pair of shoe soles worn by different persons that we wear them out very differently and should have different patterns of bounce distribution. Referring, now, to FIG. 9, a left shoe 41 comprises an embodiment of my novel sole wherein the upper layer 11 bears support blocks that each faces and folds in a different direction. A narrow support block 42, supporting a strip 43 of sheeting, slopes and collapses to the right of the shoe while a very wide support block 44 slopes toward the toe 46 of the shoe and supports a strip of sheeting 47. Narrow support blocks 48, 49 also sloping toward the toe and supporting strips 51, 52, are in line with a block 53 that supports a strip 54 and slopes toward the heel of the shoe. Two larger aligned blocks 56, 57, also slope toward the toe, while a block 58, very close to the toe, slopes toward the heel. Persons with foot problems can have soles of my invention built to order for their needs.

In the manufacture of my shoe sole the support blocks 12 and strips 14 of sheeting can advantageously, but not necessarily, be fabricated of the same chemical compound, and during one operation: natural rubber, made from concentrated latex and vulcanized with 4–8% sulfur at high temperature. Such sheetings can be obtained on the market where they are used in the manufacture of balloons or surgeon's gloves. True elastomeric films and sheetings can also be produced from urethane latices, membranes, and gaskets. Films, sheets and hoses of synthetic rubbers such as polyisobutylene or, where chemical resistance is desired, polychloroprene are also mass produced. Usually, mass produced elastomeric film sheet and hose are extruded under heat in a well known technology.

When a sheet of true elastomer is produced separately, it must be fixed or adhered to the fixation points, such as 29 and 32 of FIG. 6 and 39 and 41 of FIG. 7. In principle this fixation presents no serious obstacle, since good elastomer adhesives are well known and produced commercially. An advantage to producing the sheeting separately from the support blocks resides in the availability, then, of natural, vulcanized latices for their manufacture.

If the sheeting and support blocks are formed of the same material the support blocks will probably require greater thickness, and the material cost will be greater, but fabrication costs will be less. Apparatus for casting and injecting complex high-elasticity rubber articles of a single compound are known where both thin and thick sections of the material are required. Such articles include swim fins, inner tubes, and tires.

The foregoing description is exemplary rather than definitive of my invention for which I desire an award of Letters Patent as defined in the appended claims.

I claim:

1. A shoe sole comprising (A) a foot-supporting upper layer, (B) a plurality of support blocks comprising tough, resilient material, attached to, and extending downwardly from, said upper layer, and (C) a plurality of strips of elastic sheeting, each said strip connecting a low end of one of said support blocks to a remote area of said upper layer, whereby bending, by foot pressure, of any of said support blocks will greatly stretch at least one said strip of sheeting attached thereto.

2. The shoe sole of claim 1 wherein said support blocks slope back downwardly from the vertical.

3. The shoe sole of claim 1 wherein at least one of said support blocks extends across substantially the whole width of said sole.

4. The shoe sole of claim 1 wherein said upper layer comprises upper and lower laminations, the upper of said laminations comprising a continuous flat upper surface of said upper layer, and the lower of said laminations comprising a plurality of segments bonding to said upper lamination and to at least one of said support blocks and its attached strip of sheeting.

5. The shoe sole of claim 1 wherein said support blocks taper downwardly.

6. The shoe sole of claim 1 wherein said support blocks differ in length, thereby creating curvature of said upper layer.

7. The shoe sole of claim 1 comprising an abrasion-resistant bottom layer bonded to the lower ends of said support blocks.

8. The shoe sole of claim 7 comprising a plastic foam substantially filling the open space between said upper layer and said bottom layer.

9. The shoe sole of claim 1 wherein at least one of said support blocks extends normal to said upper layer and supports two opposingly extending of said strips of sheeting.

10. The shoe sole of claim 9 comprising side walls of sheeting between said upper layer and said bottom layer and bonded thereto, confining said plastic foam within said sole.

11. The sole of claim 1 wherein said support blocks measure about ⅝ (15.9 mm) deep×⅛" (3 mm) thick; and said sheeting measures about 1/16" (1.9 mm) in thickness.

12. The shoe sole of claim 1 wherein said one of said support blocks slopes in a different direction from others of said support blocks.

* * * * *